US009052632B2

(12) United States Patent
Tamaoki

(10) Patent No.: US 9,052,632 B2
(45) Date of Patent: Jun. 9, 2015

(54) HIGH-VOLTAGE POWER SUPPLY FOR IMAGE FORMING APPARATUS

(71) Applicant: CANON KABUSHIKI KAISHA, Tokyo (JP)

(72) Inventor: Tomohiro Tamaoki, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 113 days.

(21) Appl. No.: 13/955,960

(22) Filed: Jul. 31, 2013

(65) Prior Publication Data

US 2014/0037318 A1 Feb. 6, 2014

(30) Foreign Application Priority Data

Aug. 3, 2012 (JP) ..... 2012-173428

(51) Int. Cl.
*G03G 15/00* (2006.01)
*G03G 15/02* (2006.01)

(52) U.S. Cl.
CPC ..... *G03G 15/0283* (2013.01)

(58) Field of Classification Search
USPC ..... 399/88
See application file for complete search history.

(56) References Cited

U.S. PATENT DOCUMENTS

| | | | | |
|---|---|---|---|---|
| 5,822,652 | A * | 10/1998 | Elhatem et al. | 399/90 |
| 5,920,750 | A * | 7/1999 | Wayman et al. | 399/90 |
| 2011/0121366 | A1 * | 5/2011 | Or-Bach et al. | 257/204 |
| 2013/0004196 | A1 * | 1/2013 | Nagasaki et al. | 399/89 |

FOREIGN PATENT DOCUMENTS

| | | | |
|---|---|---|---|
| JP | 59-89536 | A | 6/1984 |
| JP | 3-244105 | A | 10/1991 |
| JP | 7-18470 | U | 1/1995 |
| JP | 2001-201921 | A | 7/2001 |
| JP | 2003-158350 | A | 5/2003 |
| JP | 2007-19273 | A | 1/2007 |
| JP | 2010-129767 | A | 6/2010 |
| JP | 2010-166653 | A | 7/2010 |
| JP | 2011-155134 | A | 8/2011 |
| JP | 2011-204426 | A | 10/2011 |
| JP | 2011-210603 | A | 10/2011 |

* cited by examiner

*Primary Examiner* — Rodney Fuller
(74) *Attorney, Agent, or Firm* — Canon USA Inc. IP Division

(57) ABSTRACT

A high-voltage power supply for an image forming apparatus compares a detected output voltage generated by dividing a high-voltage output by a voltage dividing circuit with a control value to feedback control the high-voltage output and outputs a voltage that is to be applied to a member involved in image formation. The high-voltage power supply includes a printed circuit board on which a resistor connected to a high-voltage output side of the voltage dividing circuit is mounted. A slit including a first portion and a second portion is formed in the printed circuit board. The first portion extends across a straight line connecting terminals of the resistor. The second portion continues from the first portion and extends in a direction receding from one of the terminals of the resistor.

18 Claims, 9 Drawing Sheets

HIGH-VOLTAGE POWER SUPPLY FOR IMAGE FORMING APPARATUS

BACKGROUND OF THE INVENTION

1. Field of the Invention

The present invention relates to a high-voltage power supply for an image forming apparatus using an electrophotographic method, such as a copying machine and a printer.

2. Description of the Related Art

An electrophotographic image forming apparatus includes, for example, a photosensitive drum as an electrophotographic photosensitive member. In image formation, a charging process is conducted to charge a surface of the photosensitive drum substantially uniformly to a predetermined potential. To conduct the charging process, for example, a contact charging method is used. In the contact charging method, for example, a charging roller as a charging member is brought into contact with the surface of the photosensitive drum, and a voltage is applied to the charging roller to charge the surface of the photosensitive drum.

The contact charging method includes a direct current (DC) charging method. In the DC charging method, a DC voltage value Vd+Vth is applied to the charging roller to charge the surface of the photosensitive drum to a desired potential Vd. The DC voltage value Vd+Vth is a sum of a voltage value Vd, which corresponds to a desired potential Vd of the charging roller, and a voltage value Vth. The voltage value Vth is a discharge start voltage for the photosensitive drum, which is a member to be charged, at the time of application of the DC voltage to the charging roller.

The contact charging method also includes an alternating current (AC) charging method for charging the photosensitive drum more uniformly. In the AC charging method, a charging voltage obtained by superimposition of DC voltage of a voltage value Vd corresponding to the desired potential Vd and AC voltage having a peak-to-peak voltage value (p-p voltage value) equal to or higher than a double of the voltage value Vth is applied to the charging roller. In the AC charging method, the AC voltage is superimposed so that discharges on the positive and negative sides occur alternately to charge the surface of the photosensitive drum more uniformly.

In the AC charging method, if AC voltage of a sine wave is applied to the charging roller, a resistive load current flows in a resistive load between the charging roller and the photosensitive drum, a capacitive load current flows in a capacitive load between the charging roller and the photosensitive drum, and a discharge current flows between the charging roller and the photosensitive drum. In other words, the sum of the currents flows into the charging roller. It is empirically known that it is desirable to set the amount of discharge current to a predetermined amount or larger to stably charge a surface of a photosensitive drum.

However, when an excessive amount of discharge current flows, the photosensitive drum may be scraped to expedite deterioration of the photosensitive drum, or an abnormal image may be formed such as image deletion (distortion of electrostatic latent image due to a decrease in resistance of photosensitive drum) in a hot and humid environment due to a corona product. To prevent such expedition of deterioration of the photosensitive drum and formation of an abnormal image, it is desirable to apply AC voltage to minimize discharges generated to the positive and negative sides alternately.

To stably supply high-quality images over a long period of time, it is required to control the voltage value of AC voltage to be applied to the charging roller and the value of current flowing into the charging roller by application of AC voltage to realize uniform charging without excessive discharging. As a method of such a control, a discharge current control method is discussed in Japanese Patent Application Laid-Open No. 2001-201921 in which the voltage value of AC voltage is determined to obtain a desired amount of discharge current at the time of image formation. In the discharge current control, AC current values are measured at the time of application of AC voltage of a p-p voltage value in a non-discharging range lower than a double of the discharge start voltage Vth and at the time of application of AC voltage of a p-p voltage value in a discharging range equal to or higher than the double of the discharge start voltage Vth. Based on the measurement results, the p-p voltage value of AC voltage at the time of image formation is determined.

To conduct the discharge current control, it is important to output the amplitude of AC voltage with adequate accuracy at each measurement point. In an AC voltage generation circuit, a transformer driving circuit drives a primary side of an AC transformer to generate AC voltage, which is high-voltage, on a second side of the AC transformer. A p-p voltage detection circuit detects the AC voltage on the second side. In the p-p voltage detection circuit, a voltage doubling circuit stores the p-p voltage as DC voltage in a capacitor. Since the voltage is a high voltage of 1 kV or higher, the voltage is divided by two resistors to be converted into a voltage that is applicable to an ordinary operational amplifier integrated circuit (IC). A resistor with a high withstand voltage and a high resistance value (high-voltage resistor) is used as one of the resistors used to divide voltage.

Meanwhile, the photosensitive drum charged to the desired potential Vd is exposed to light such as laser light modulated according to image data. The exposure neutralizes the surface of the photosensitive drum to form a V1 potential, whereby an electrostatic latent image (electrostatic image) is formed on the surface of the photosensitive drum. The electrostatic latent image is developed with toner to form a toner image on the surface of the photosensitive drum. The toner is stored and conveyed by, for example, a development sleeve as a developer bearing member and supplied to the photosensitive drum.

A development DC voltage Vdc is applied to the development sleeve to give an electric potential for development. The image density is determined by a potential difference between the voltage value Vdc and the potential V1. By maintaining the potential difference between the potential Vd and the voltage value Vdc at a predetermined value, carrier contained in a two-component developer and fogging toner (toner adhering to a non-image portion) can be prevented from adhering to the photosensitive drum. Accordingly, adequate accuracy is also required with respect to the voltage values Vd and Vdc.

To generate the voltage values Vd and Vdc, a circuit that divides an output voltage to convert it into a voltage applicable to the operational amplifier IC is used to maintain the voltage values constant. A high-voltage resistor with a high resistance value is used as one of the resistors for use in dividing voltage, as in the p-p voltage detection circuit.

However, the high-voltage power supply for an image forming apparatus that controls an output voltage generated by dividing a high-voltage output by a voltage dividing circuit to be maintained constant, has the following problem to be improved.

In an image forming apparatus, dew condensation may occur due to a change in an installation environment. Especially in the winter morning, when the environmental temperature in a chilly installation environment is increased rapidly due to use of a stove in the installation environment, significant dew condensation may occur. In such a case, dew condensation is likely to occur on a high-voltage power supply circuit board in an image forming apparatus.

Since a high-voltage resistor of a voltage dividing circuit that divides a high-voltage output has a significantly high resistance value, when dew condensation occurs on a circuit board on which the high-voltage resistor is mounted, the dew condensation causes leakage current to decrease a substantial resistance value, and the divided voltage becomes higher than the set value.

In general, a phenolic paper circuit board is used as a printed circuit board for use in a high-voltage power supply. Compared to other glass epoxy circuit boards, a phenolic paper circuit board is less likely to repel water drops formed by dew condensation. As to a high-voltage resistor, if a high-voltage resistor with a resin-coated surface is used, water drops are repelled and a continuous path is less likely to be formed by dew condensation on a surface of the resistor. Since a control circuit controls a divided voltage to be a predetermined value as described above, an output voltage becomes smaller than a desired value.

When an environmental temperature changes, the condition of dew condensation on a circuit board also changes, and a substantial resistance value including leakage current may change every second. If, for example, the discharge current control is performed under the situation in which the substantial resistance value changes, an adequate control result cannot be obtained. Thus, shortage of discharge current may occur during image formation to cause a fogged image (image with toner adhering to a non-image portion) due to charging failure and image deletion due to excessive discharging.

As to the control of the output voltages Vd and Vdc, if dew condensation occurs between terminals of a high-voltage resistor on a circuit board during image formation, a desired voltage may not be output to cause density failure, or an output voltage may change to cause uneven density.

Japanese Patent Application Laid-Open Nos. 2011-204426 and 2011-210603 discuss methods of preventing sparks in a magnetron driving power supply, which may be generated when a high-voltage resistor for discharging a high voltage is short-circuited by water drops adhering to the high-voltage resistor. In the methods, a slit is formed in a printed circuit board under the high-voltage resistor. The methods can reduce a flow of a large amount of current that may lead to a spark. However, the methods cannot adequately prevent generation of minor leakage current.

SUMMARY OF THE INVENTION

The present invention is directed to a high-voltage power supply for an image forming apparatus that controls an output voltage generated by dividing a high-voltage output by a voltage dividing circuit to maintain the output voltage constant and is capable of preventing generation of leakage current between terminals of a high-voltage resistor of the voltage dividing circuit even when an environmental change that is likely to cause condensation occurs.

According to an aspect of the present invention, a high-voltage power supply for an image forming apparatus configured to compare a detected output voltage generated by dividing a high-voltage output by a voltage dividing circuit with a control value to feedback control the high-voltage output and outputs a voltage to be applied to a member involved in image formation, includes a printed circuit board on which a resistor connected to a high-voltage output side of the voltage dividing circuit is mounted, and a slit formed in the printed circuit board and including a first portion and a second portion, the first portion extending across a straight line connecting terminals of the resistor, and the second portion continuing from the first portion and extending in a direction receding from one of the terminals of the resistor.

Further features of the present invention will become apparent from the following detailed description of exemplary embodiments with reference to the attached drawings.

DESCRIPTION OF THE EMBODIMENTS

A high-voltage power supply for an image forming apparatus according to an exemplary embodiment of the present invention is described in detail with reference to the attached drawings.

1. Image Forming Apparatus

Figure 1:
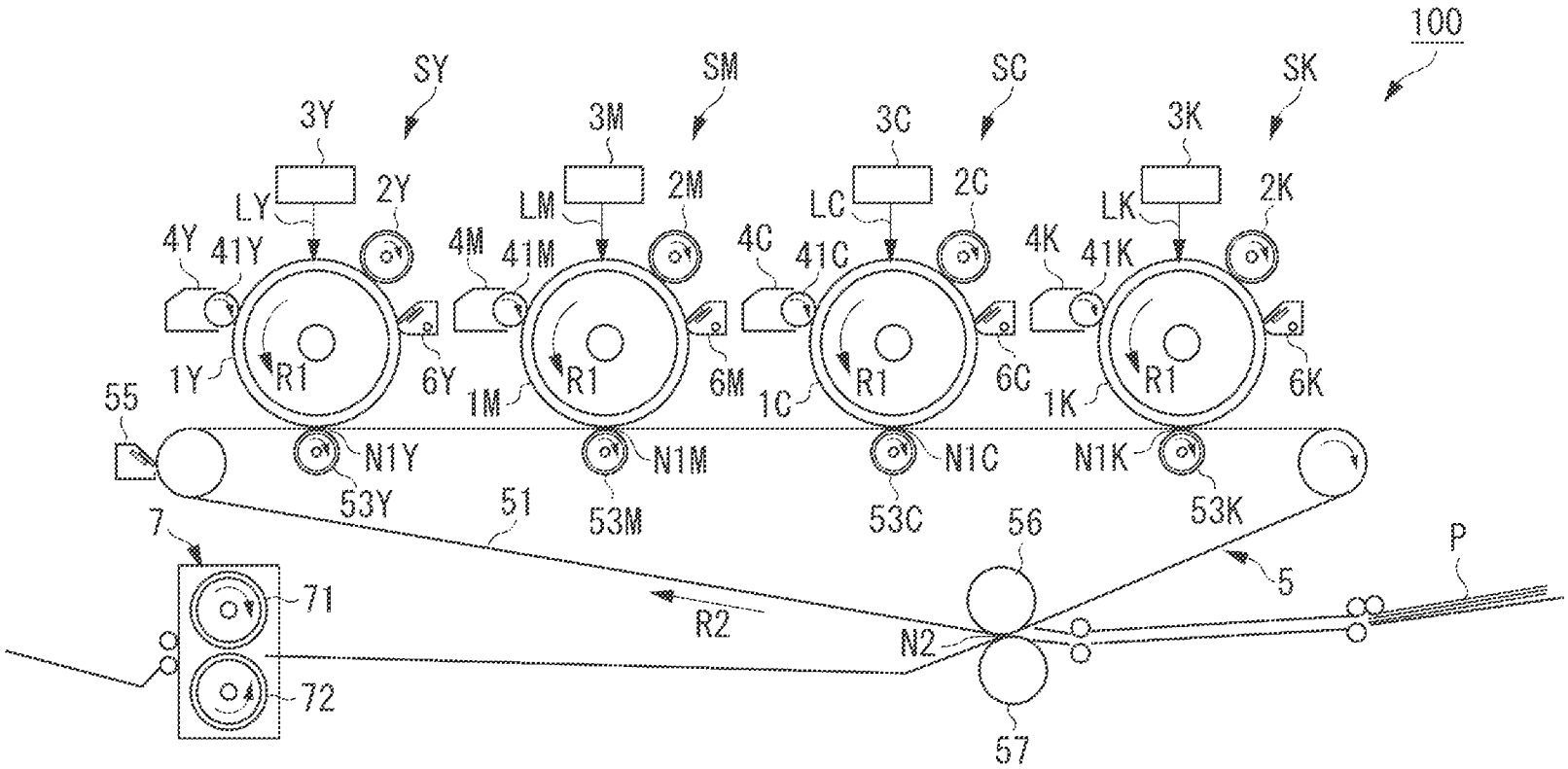
FIG. 1 is a schematic cross sectional view of an example of an image forming apparatus including a high-voltage power supply according to an exemplary embodiment of the present invention.

FIG. 1 is a schematic cross sectional view of an image forming apparatus 100 including a high-voltage power supply (high-voltage power supply circuit) according to an exemplary embodiment of the present invention. The image forming apparatus 100 is a laser beam printer of an intermediate transfer method that is capable of forming a full-color image using an electrophotographic method.

The image forming apparatus 100 includes four image forming units (stations) SY, SM, SC, and SK configured to form images of yellow (Y), magenta (M), cyan (C), and black (K), respectively. In the present exemplary embodiment, the structures and operations of the image forming units SY, SM, SC, and SK are substantially the same, except that the color of toner to be used is different. Hence, unless specific discrimination is needed, the image forming units will be described collectively without specifying the last alphabets Y, M, C, and K that indicate colors in charge of the respective image forming units.

The image forming unit includes a photosensitive drum, which is a drum-type electrophotographic photosensitive member (photosensitive member), as an image bearing member. The photosensitive drum 1 is rotated in the direction of an arrow R1 (anticlockwise) illustrated in FIG. 1. Around the photosensitive drum 1 are disposed the following units in the following order along the rotation direction. First, a charging roller 2, which is a roller-type charging member, is disposed as a charging unit. Next, an exposure device (laser scanner) 3 is disposed as an exposure unit. Next, a development device 4 is disposed as a development unit. Next, a transfer device 5 is disposed. Next, a photosensitive member cleaner 6 is disposed as a photosensitive member cleaning unit. The development device 4 stores toner as a developer. The development device 4 includes a development sleeve 41 as a developer bearing member that bears and conveys the toner to a portion facing the photosensitive drum 1.

The transfer device 5 includes an intermediate transfer belt 51, which is an intermediate transfer member as an image bearing member in a shape of an endless belt. The intermediate transfer belt 51 is stretched around a plurality of stretching rollers with a predetermined tensile force. The intermediate transfer belt 51 is rotated in the direction of an arrow R2 (clockwise) illustrated in FIG. 1. On the inner circumferential surface side of the intermediate transfer belt 51, primary transfer rollers 53Y, 53M, 53C, and 53K are disposed to face the photosensitive drums 1Y, 1M, 1C, and 1K, respectively. Each of the primary transfer rollers 53Y, 53M, 53C, and 53K is a primary transfer member as a primary transfer unit in the shape of a roller. The primary transfer roller 53 is pressed against the photosensitive drum 1 via the intermediate transfer belt 51. A primary transfer portion N1 is formed at a portion where the photosensitive drum 1 and the intermediate transfer belt 51 are brought into contact with each other. On the outer circumferential surface side of the intermediate transfer belt 51, a secondary transfer roller 57 is disposed to face a secondary transfer counter roller 56, which is one of the plurality of stretching rollers. The secondary transfer roller 57 is a secondary transfer member as a secondary transfer unit in the shape of a roller. The secondary transfer roller 57 is pressed against the secondary transfer counter roller 56 via the intermediate transfer belt 51. A secondary transfer portion N2 is formed at a portion where the intermediate transfer belt 51 and the secondary transfer roller 57 are brought into contact with each other. On the outer circumferential surface side of the intermediate transfer belt 51, an intermediate transfer belt cleaner 55 is disposed as an intermediate transfer member cleaning unit.

The image forming apparatus 100 further includes a recording material feeding unit and a fixing device 7. The recording material feeding unit is provided to feed a recording material P such as a paper sheet and an OHP sheet to the secondary transfer portion N2. The fixing device 7 is a fixing unit disposed downstream of the secondary transfer portion N2 in the direction in which the recording material P is conveyed. The fixing device 7 includes a heating source and a pair of fixing rollers 71 and 72 being in pressure-contact with each other.

Figure 2:
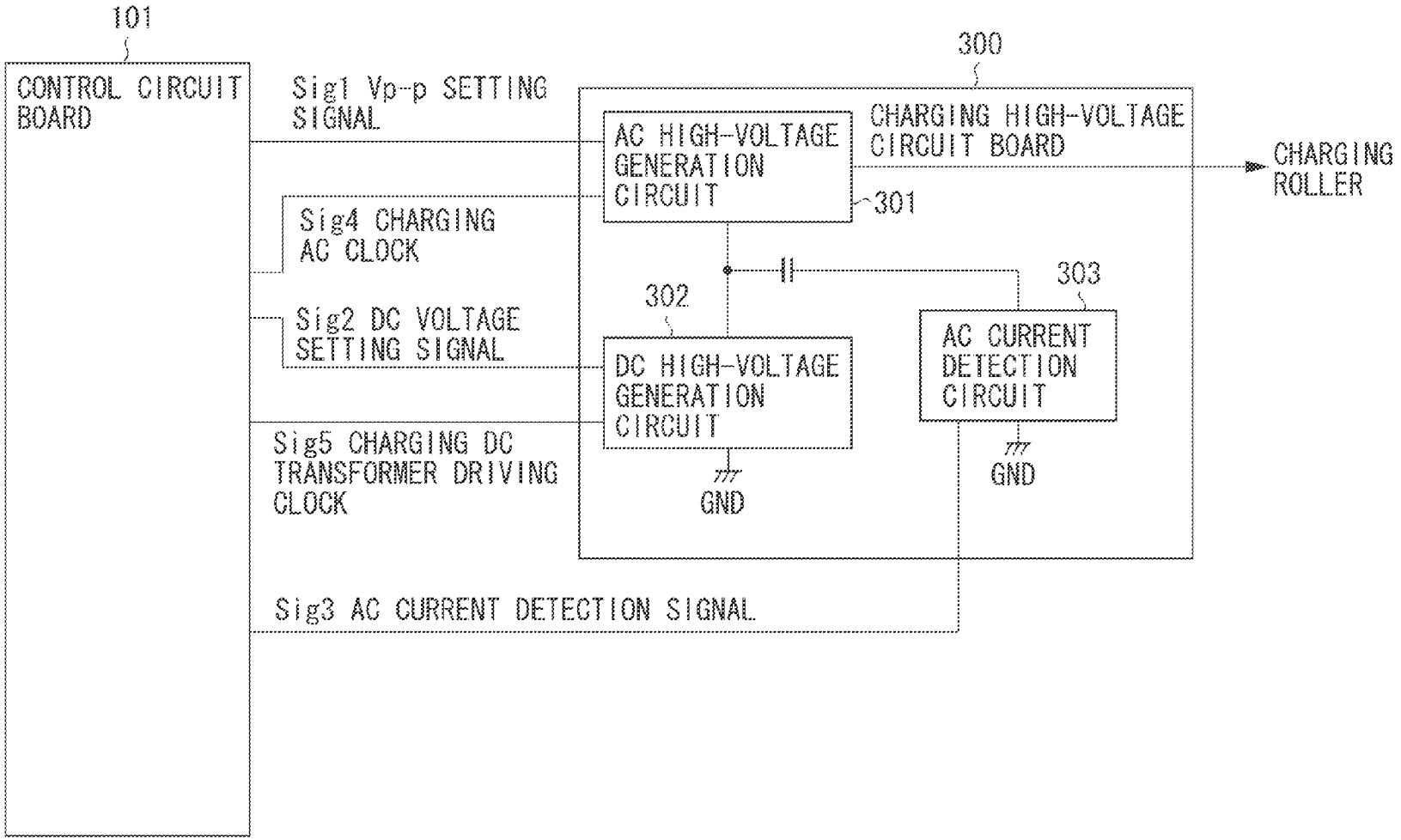
FIG. 2 is a block diagram illustrating schematic configurations of a charging high-voltage circuit board and a control circuit board of an image forming apparatus according to an exemplary embodiment of the present invention.

In image formation, a central processing unit (CPU) (not illustrated) of a control circuit board 101 illustrated in FIG. 2, which controls the entire image forming apparatus 100, issues an instruction to form an image on the recording material P. In response to the instruction, the photosensitive drum 1, the intermediate transfer belt 51, the charging roller 2, the development sleeve 41, the primary transfer roller 53, the secondary transfer roller 56, and the pair of fixing rollers 71 and 72 are started rotating.

The charging roller 2 is connected to a charging high-voltage circuit board 300 illustrated in FIG. 2. The charging high-voltage circuit board 300 applies to the charging roller 2 a vibration voltage (high voltage) generated by superimposition of a DC voltage and a sine-wave AC voltage, whereby the surface of the photosensitive drum 1 that is in contact with the charging roller 2 is uniformly charged.

The charged surface of the photosensitive drum 1 is moved by the rotation of the photosensitive drum 1 from the exposure device 3 to a laser irradiation position to which laser light L is applied. The exposure device 3 scans and exposes the charged surface with the laser light L corresponding to an image signal, whereby an electrostatic latent image (electrostatic image) is formed on the photosensitive drum 1.

Thereafter, the electrostatic latent image formed on the photosensitive drum 1 is moved by the rotation of the photosensitive drum 1 to a portion where the development sleeve 41 of the development device 4 faces the photosensitive drum 1, and the development device 4 develops the electrostatic latent image with toner. The development sleeve 41 of the development device 4 is connected to a development high-voltage circuit board (not illustrated). The development high-voltage circuit board applies to the development sleeve 41 a vibration voltage (high voltage) generated by superimposition of a DC voltage and an AC voltage having a rectangular pulse waveform. In the present exemplary embodiment, the negatively charged toner on the development sleeve 41 is attached to an image portion of the electrostatic latent image of a positive potential (positive with respect to the development sleeve 41, negative with respect to a ground (GND)). In other words, in the present exemplary embodiment, the electrostatic latent image is developed by reversal development in which toner charged to have the same polarity as the charging polarity (negative in the present exemplary embodiment) of the photosensitive drum 1 is attached to an exposed portion of the photosensitive drum 1 having been uniformly charged and then exposed so that the absolute value of electric potential has been decreased.

Thereafter, the toner image formed on the photosensitive drum 1 is moved by the rotation of the photosensitive drum 1 to the primary transfer portion N1 and transferred (primary transfer) by an action of the primary transfer roller 53 onto the intermediate transfer belt 51 as a member to be transferred. At this time, a primary transfer high-voltage circuit board (not illustrated) applies a DC voltage to the primary transfer roller 53 to transfer the toner image from the photosensitive drum 1 onto the intermediate transfer belt 51. For example, in full-color image formation, the toner images on the four photosensitive drums 1Y, 1M, 1C, and 1K are transferred (primary transfer) by actions of the primary transfer rollers 53Y, 53M, 53C, and 53K onto the intermediate transfer belt 51 sequentially on top of another.

Thereafter, the toner image transferred onto the intermediate transfer belt 51 is moved by the rotation of the intermediate transfer belt 51 to the secondary transfer portion N2 and transferred (secondary transfer) by an action of the secondary transfer roller 57 onto the recording material P as a member to be transferred. At that time, a secondary transfer high-voltage circuit board (not illustrated) applies a DC voltage to the secondary transfer roller 57 to transfer the toner image from the intermediate transfer belt 51 onto the recording material P.

The photosensitive member cleaner 6 scrapes and collects the toner (primary transfer residual toner) remaining on the photosensitive drum 1 after the primary transfer. The intermediate transfer belt cleaner 55 scrapes and collects the toner (secondary transfer residual toner) remaining on the intermediate transfer belt 51 after the secondary transfer.

The toner image transferred onto the recording material P is fixed to the recording material P by the fixing device 7 with pressure and heat, whereby, for example, a full-color image is obtained.

2. Discharge Current Control

A brief summary of the discharge current control for controlling the p-p voltage value of AC voltage to be applied to the charging roller 2 and conventional problems will be further described.

Figure 9:
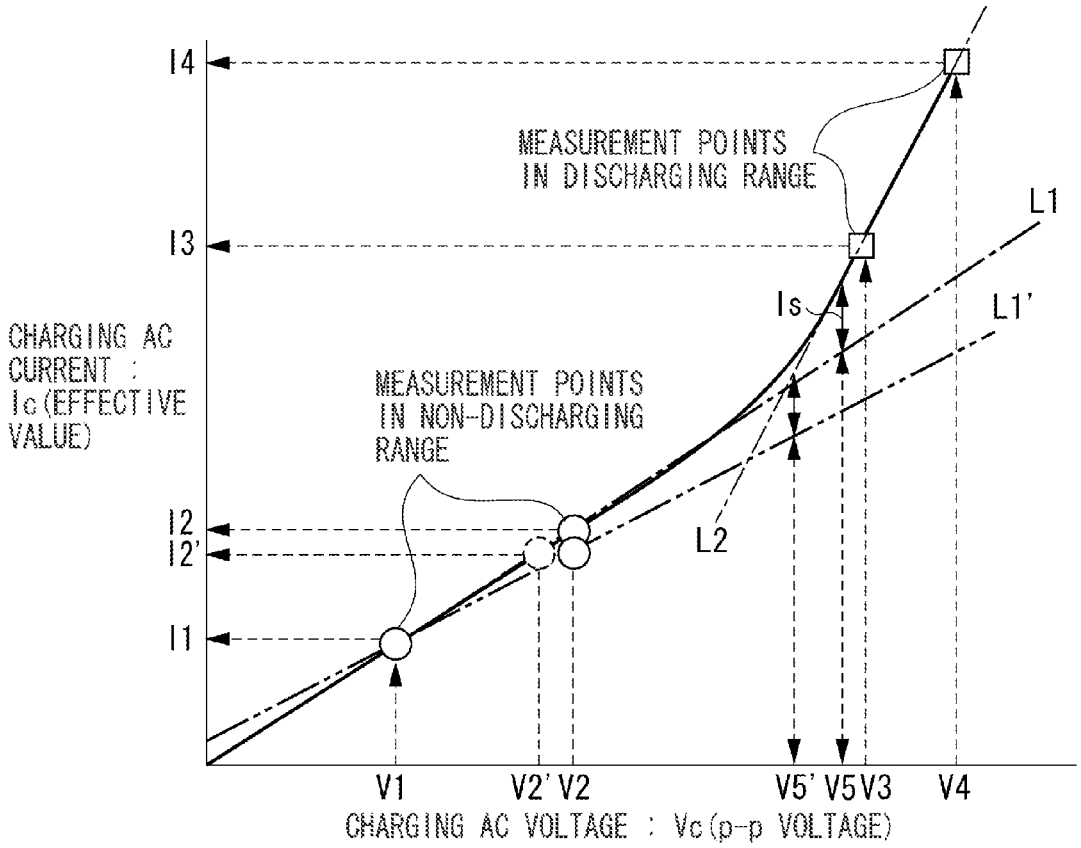
FIG. 9 is a graph illustrating discharge current control and a conventional problem.

FIG. 9 illustrates an approximate straight line (dashed-dotted line) regarding voltage-current characteristics obtained when the discharge current control is performed normally, and an example of an approximate straight line (dashed-two dotted line) obtained when the voltage control is not performed normally due to dew condensation in the charging high-voltage circuit board 300.

In the discharge current control, AC current values at the time of application of AC voltage of p-p voltage values of a non-discharging range smaller than a double of a discharge start voltage Vth and a discharging range equal to or greater than the double of the discharge start voltage Vth are measured. Based on the measurement results, the p-p voltage values of AC voltage at the time of image formation are determined Measurement points V1 and V2 are measurement points of the non-discharging range. An AC high-voltage generating circuit 301 illustrated in FIG. 2 of the charging high-voltage circuit board 300 illustrated in FIG. 2 applies a voltage to the charging roller 2, and an AC current detection circuit 303 illustrated in FIG. 2 measures AC currents I1 and I2 at this time. Measurement points V3 and V4 are measurement points of the discharging range, and AC currents I3 and I4 are measured similarly.

From a straight line L1 connecting the measurement points of the non-discharging range and a straight line L2 connecting the measurement points of the discharging range, in the control circuit board 101 illustrated in FIG. 2, a voltage V5 at which a discharge current Is is a predetermined value is obtained, and the voltage V5 is determined as the p-p voltage value of AC voltage to be applied to the charging roller 2 at the time of image formation.

At this time, if, for example, dew condensation occurs between terminals of a high-voltage resistor of the voltage dividing circuit of the charging high-voltage circuit board 300 during the measurement of V2, V2 may become V2' that is lower than a desired voltage. In this case, only the voltage V2', which is lower than the desired voltage, is applied to the charging roller 2. Thus, the value of the flowing current becomes I2', which is smaller than the normal current value I2. As a result, a straight line L1' (dashed-two dotted line) connecting the measurement points of the non-discharging range deviates from the straight line L1 (dashed-dotted line).

When a voltage output value during the measurement of the measurement points V3 and V4 of the discharging range is normal, a voltage at which the discharge current Is is a predetermined value and that is obtained from the straight lines L1' and L2 is V5', which is lower than V5 of a case in which no dew condensation occurs. Thus, the discharge current is insufficient. This may cause a charging failure during image formation to produce a fogged image.

3. Charging High-Voltage Circuit Board

FIG. 2 is a block diagram illustrating schematic configurations of the charging high-voltage circuit board 300 and the control circuit board 101. As illustrated in FIG. 2, the image forming apparatus 100 includes the charging high-voltage circuit board 300 and the control circuit board 101.

The control circuit board 101 includes a CPU (not illustrated) and a memory (not illustrated). The CPU is a control unit configured to control the entire image forming apparatus 100. The memory is a storage unit configured to store programs for the control. The charging high-voltage circuit board 300 includes the AC high-voltage generating circuit 301 and the DC high-voltage generating circuit 302, which are high-voltage power supplies (high-voltage power supply circuits) according to the present exemplary embodiment. The charging high-voltage circuit board 300 also includes the AC current detection circuit 303.

The control circuit board 101 outputs the following signals to the charging high-voltage circuit board 300: a Sig1 Vp-p setting signal, which is a voltage signal for setting the p-p voltage value Vp-p of an AC high-voltage of the AC high-voltage generating circuit 301; a Sig2 DC voltage setting signal, which is a voltage signal for setting a voltage value of a DC high-voltage of the DC high-voltage generating circuit 302; a Sig4 charging AC clock, which determines the frequency of a waveform of a charging AC high-voltage of the AC high-voltage generating circuit 301; and a Sig5 charging DC transformer driving clock, which drives a transformer of the DC high-voltage generating circuit 302. The control circuit board 101 receives as an input a Sig3 AC current detection signal, which is an output signal of the AC current detection circuit 303 of the charging high-voltage circuit board 300.

Figure 3:
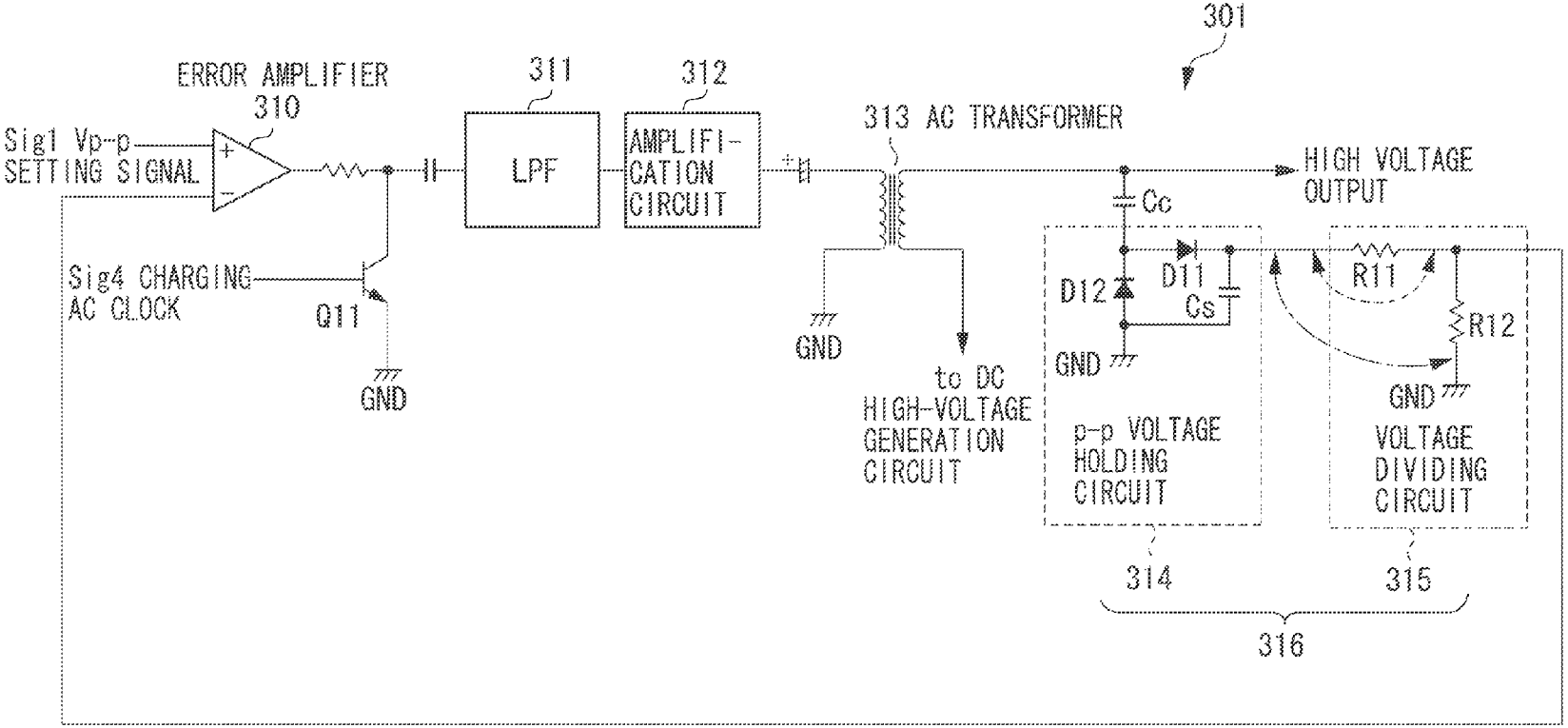
FIG. 3 is a circuit diagram of an AC high-voltage generating circuit as a high-voltage power supply according to an exemplary embodiment of the present invention.

FIG. 3 is a circuit diagram of the AC high-voltage generating circuit 301.

An error amplifier 310 receives as inputs the Sig1 Vp-p setting signal and an output of a voltage dividing circuit 315. An output voltage of the error amplifier 310 is adjusted so that the two voltages match each other. A transistor Q11 to which base the Sig4 charging AC clock is input turns on/off the output of the error amplifier 310. A low pass filter (LPF) 311 receives the output as a rectangular wave with the amplitude determined by the output voltage of the error amplifier 310 and the frequency determined by the Sig4 charging AC clock. The LPF311 eliminates high-frequency components of the rectangular wave. As a result, the output is converted into a sine waveform and then input to an amplification circuit 312.

The amplification circuit 312 amplifies electric current to drive an AC transformer 313. An output of the amplification circuit 312 drives a primary side of the AC transformer 313. One terminal of a secondary side of the AC transformer 313 is connected to the DC high-voltage generating circuit 302 illustrated in FIG. 2. The other terminal of the second side of the AC transformer 313 is an output terminal for a high-voltage output with respect to the charging roller 2. The output terminal is connected to a p-p voltage detection circuit 316 including a p-p voltage holding circuit 314 and a voltage dividing circuit 315 to detect the p-p voltage of AC voltage.

The p-p voltage holding circuit 314 includes a coupling capacitor Cc and a voltage doubling circuit (diode D11, diode D12, capacitor Cs). The p-p voltage holding circuit 314 converts the p-p voltage of an AC voltage to a DC voltage and holds the DC voltage. When the p-p voltage value of AC high voltage is 2 kVp-p, the capacitor Cs stores a voltage that is equal to 2 kV minus a forward voltage Vf of the diodes D11 and D12. The voltage dividing circuit 315 divides the high voltage stored in the capacitor Cs through resistors R11 and R12 into a voltage that is applicable to the error amplifier 310. The values of the resistors R11 and R12 of the voltage dividing circuit 315 are, for example, 100 MΩ and 330 kΩ, respectively. Accordingly, when, for example, the capacitor Cs is charged to 2 kV, the divided voltage is 6.6 V.

The error amplifier 310 adjusts its output voltage the voltage dividing circuit 315 so that output voltage of the voltage dividing circuit 315 matches the voltage of the Sig1 Vp-p setting signal input from the control circuit board 101. This enables the control circuit board 101 to use the voltage (control value, target value, reference value) of the Sig1 Vp-p setting signal to control the p-p voltage value Vp-p of AC high voltage output from the AC high-voltage generating circuit 301. The error amplifier 310 compares the voltage of the Sig1 Vp-p setting signal with the output voltage of the voltage dividing circuit 315. If the output voltage of the voltage dividing circuit 315 is lower than the voltage of the Sig1 Vp-p setting signal, the error amplifier 310 increases the output voltage of the voltage dividing circuit 315. If the output voltage of the voltage dividing circuit 315 is higher than the voltage of the Sig1 Vp-p setting signal, the error amplifier 310 lower the output voltage of the voltage dividing circuit 315.

Figure 4:
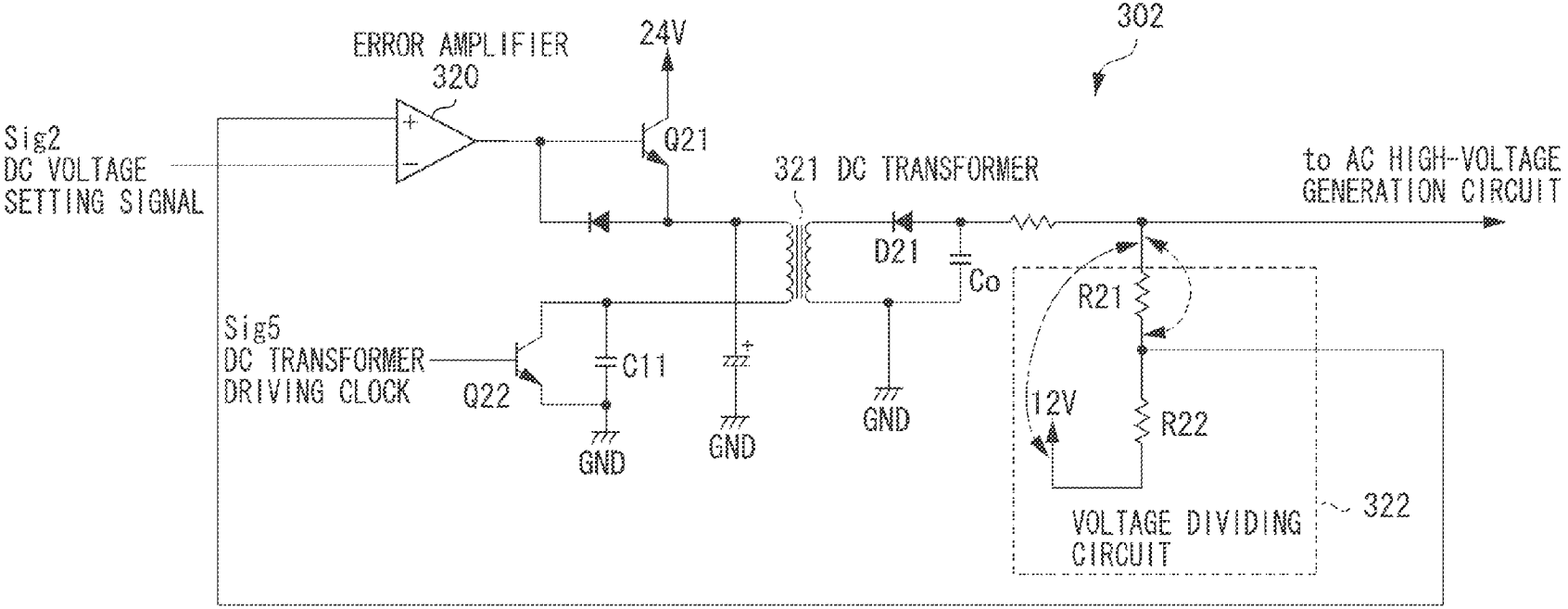
FIG. 4 is a circuit diagram of a DC high-voltage generating circuit as a high-voltage power supply according to an exemplary embodiment of the present invention.

FIG. 4 is a circuit diagram of the DC high-voltage generating circuit 302.

The error amplifier 320 receives as inputs the Sig2 DC voltage setting signal and the output of the voltage dividing circuit 322. Then, the output voltage of the error amplifier 320 is adjusted so that the two voltages match each other. The output of the error amplifier 320 is connected to a base of a transistor Q21 to constitute a voltage regulator configured to adjust a voltage to be supplied to a DC transformer 321. The primary side electric current of the DC transformer 321 is on and off by a transistor Q22 whose base is connected to the Sig5 DC transformer driving clock. The DC transformer 321 and a capacitor C11 form a flyback resonant converter. A capacitor Co on a secondary side of the DC transformer 321 is charged via a diode D21 during an off period of the transistor Q22 to obtain a DC high-voltage output. Since the polarity of the DC high-voltage output is negative, the DC high-voltage output is divided by resistors R21 and R22 of the voltage dividing circuit 322 between 12 V into a voltage that is applicable to the error amplifier 320. The voltage dividing circuit 322 constitutes a DC voltage detection circuit configured to detect a voltage value of DC voltage. The values of the resistors R21 and R22 of the voltage dividing circuit 322 are, for example, 10 MΩ and 120 kΩ, respectively. Accordingly, when, for example, the DC high-voltage output is −800 V, the divided output is 2.37 V.

The error amplifier 320 adjusts its output voltage so that the output voltage of the voltage dividing circuit 322 and the voltage of the Sig2 DC voltage setting signal input from the control circuit board 101 match each other. This enables the control circuit board 101 to use the voltage of the Sig2 DC voltage setting signal to control the voltage value of the DC high voltage output from the DC high-voltage generating circuit 302. The error amplifier 320 compares the voltage (control value, target value, reference value) of the Sig2 DC voltage setting signal with the output voltage of the voltage dividing circuit 322. If the output voltage of the voltage dividing circuit 322 is higher than the voltage of the Sig2 DC voltage setting signal, the error amplifier 320 increases the output voltage of the voltage dividing circuit 322. If the output voltage of the voltage dividing circuit 322 is lower than the voltage of the Sig2 DC voltage setting signal, the error amplifier 320 lowers the output voltage of the voltage dividing circuit 322.

In the present exemplary embodiment, the development high-voltage circuit board (not illustrated) also uses a DC high-voltage generating circuit that is feedback controlled by an error amplifier similar to that illustrated in FIG. 4. As to the primary transfer high-voltage circuit board (not illustrated) and the secondary transfer high-voltage circuit board (not illustrated), substantially the same DC high-voltage generating circuit may be used.

As described above, in the present exemplary embodiment, the voltage dividing circuits of the AC high-voltage generating circuit 301 and the DC high-voltage generating circuit 302 of the charging high-voltage circuit board 300 divide a high voltage and input the divided voltage to the error amplifiers to control the output voltage so as to maintain the output voltage constant. In other words, the AC high-voltage generating circuit 301 and the DC high-voltage generating circuit 302 include the detection circuits 316 and 322, respectively. The detection circuits 316 and 322 detect the high-voltage outputs of the AC high-voltage generating circuit 301 and the DC high-voltage generating circuit 302 through the divided voltage divided by the voltage dividing circuits 315 and 322. The error amplifiers (comparator, feedback circuit) 310 and 320 compare the output voltages of the detection circuits 316 and 322 with control values, respectively, to feedback control the high-voltage outputs to be constant. Then, the AC high-voltage generating circuit 301 and the DC high-voltage generating circuit 302 output a voltage to be applied to the charging roller 2 as a member involved in image formation.

Resistors (high-voltage endurance resistors) with a high withstand voltage and a high resistance value are used as the resistors R11 and R21 on the high-voltage output sides of the voltage dividing circuits 315 and 322 of the AC high-voltage generating circuit 301 and the DC high-voltage generating circuit 302. When leakage current flows across the terminals (illustrated with dashed arrows in FIGS. 3 and 4) of the high-voltage resistors R11 and R21 due to dew condensation in the printed circuit boards on which the high-voltage resistors R11 and R12 are mounted, the apparent resistance values become small. Accordingly, as a result of the generation of the leakage current, the outputs of the voltage dividing circuits 315 and 322 are shifted to a higher side than the set outputs.

On the other hand, leakage current (illustrated with dashed-dotted arrows in FIGS. 3 and 4) generated between the high voltage sides of the high-voltage resistors R11 and R21 and GND illustrated in FIG. 3 or 12 V illustrated in FIG. 4 does not affect the outputs of the voltage dividing circuits 315 and 322. Therefore, the generation of the leakage current does not affect the control performed to maintain constant the high-voltage outputs of the AC high-voltage generating circuit 301 and the DC high-voltage generating circuit 302.

Hence, it is important to prevent leakage current from flowing across the terminals of the high-voltage resistors R11 and R21 due to dew condensation.

4. Slit

Next, a slit formed in a printed circuit board will be described. In the following description, the AC high-voltage generating circuit 301 of the charging high-voltage circuit board 300 is described as an example.

FIGS. 5 to 8 each illustrate an example in which a slit 330 is added to a printed circuit board 340, on which the high-voltage resistors R11 and R12 are mounted, of the AC high-voltage generating circuit 301 to prevent dew condensation. FIGS. 5 to 8 illustrate the printed circuit board 340, on which constituent components of the AC high-voltage generating circuit 301 are mounted, viewed from a direction substantially orthogonal to a surface of the printed circuit board 340. Each of the sheets of FIGS. 5 to 8 corresponds to a surface of a substrate of the printed circuit board 340.

On the printed circuit board 340 is formed a copper foil pattern 350, which is a wiring pattern (conductor pattern). Electronic components including the high-voltage resistor R11 are connected (soldered) to lands (or pads) of the copper foil pattern 350 via terminals (leads). The slit 330 is formed in the printed circuit board 340. The slit 330 is a groove penetrating the substrate of the printed circuit board 340.

The slit 330 is formed in such a manner that a path (creeping path) connecting both terminals of the high-voltage resistor R11 along the surface of the printed circuit board 340 bypasses the slit 330. The slit 330 is formed to prevent formation of a leakage current path between the terminals of the high-voltage resistor R11 due to continuous condensation when dew condensation occurs. In other words, the slit 330 is formed to increase the creeping distance between the terminals of the high-voltage resistor R11.

Formation of a leakage current path by "continuous" dew condensation is intended to be prevented because of the following reason. Experiments conducted by the present inventor confirmed that even when water drops were formed on a printed circuit board due to dew condensation, if terminals of a resistor were not connected continuously by the water drops, an output of a voltage dividing circuit would not be changed by leakage current.

In the present exemplary embodiment, the slit 330 is formed in the printed circuit board 340 on which the high-voltage resistor R11 is mounted. The basic structure of the slit 330 is as follows. The slit 330 includes a first portion 331 and a second portion 332. The first portion 331 extends across a straight line I, which connects the terminals of the high-voltage resistor R11. The second portion 332 continues from the first portion 331 and extends in a direction receding from one of the terminals of the high-voltage resistor R11.

Figure 5:
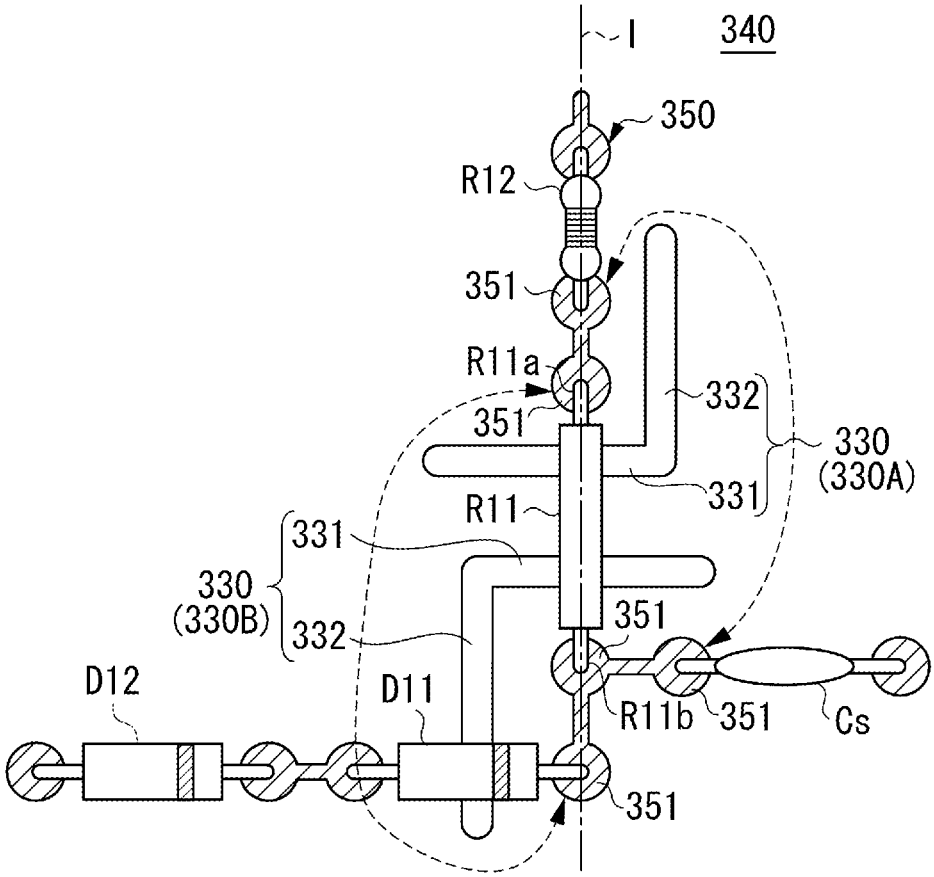
FIG. 5 is a schematic view illustrating an example of a slit formed in a printed circuit board of a high-voltage power supply according to an exemplary embodiment of the present invention.
Figure 6:
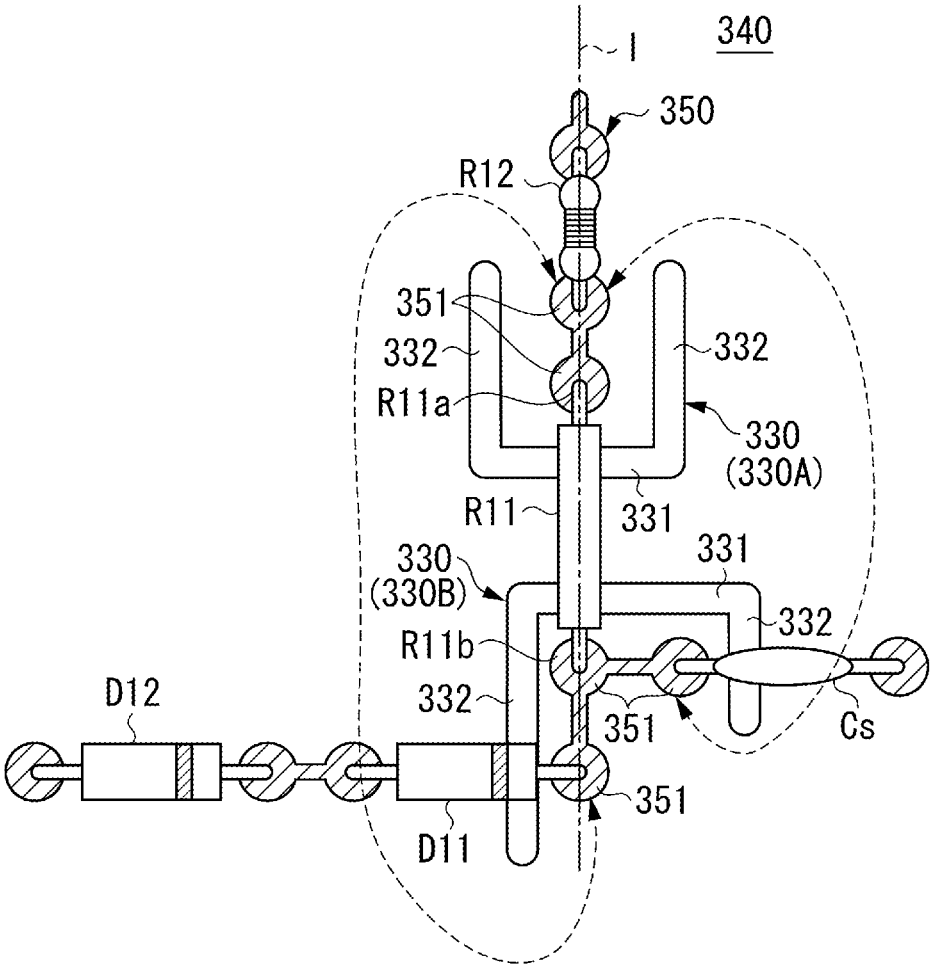
FIG. 6 is a schematic view illustrating another example of a slit formed in a printed circuit board of a high-voltage power supply according to an exemplary embodiment of the present invention.
Figure 7:
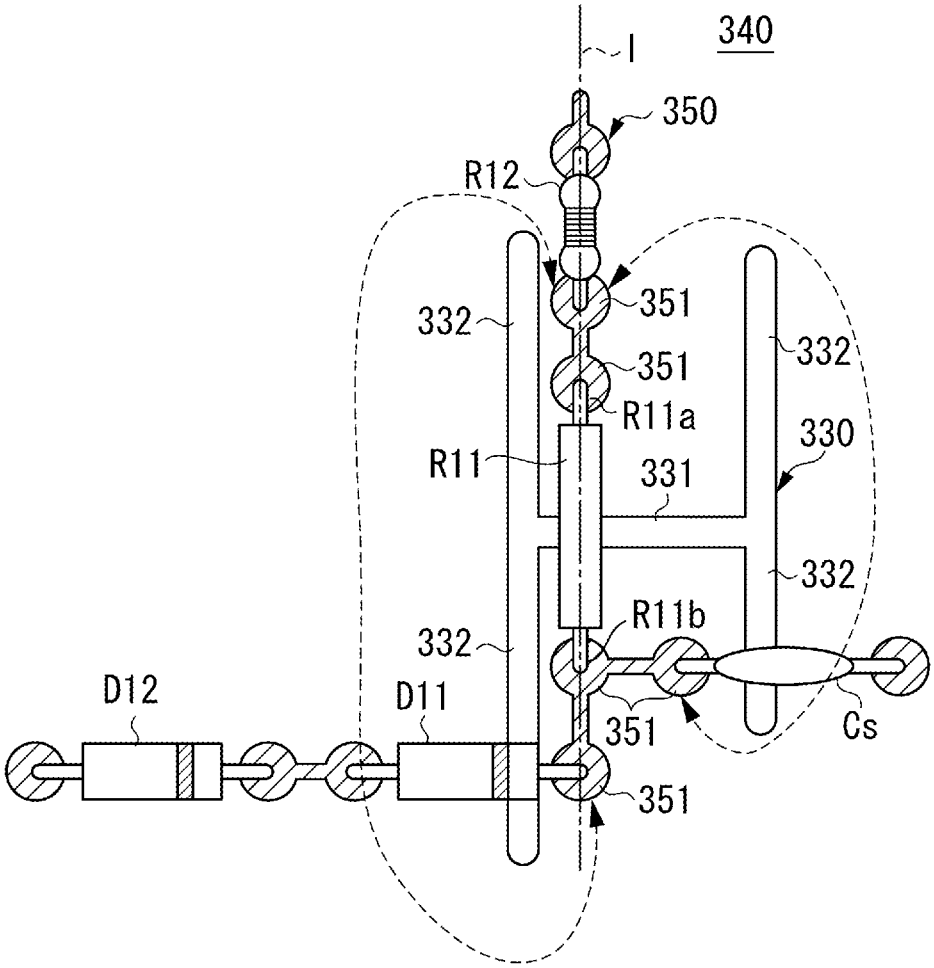
FIG. 7 is a schematic view illustrating another example of a slit formed in a printed circuit board of a high-voltage power supply according to an exemplary embodiment of the present invention.
Figure 8:
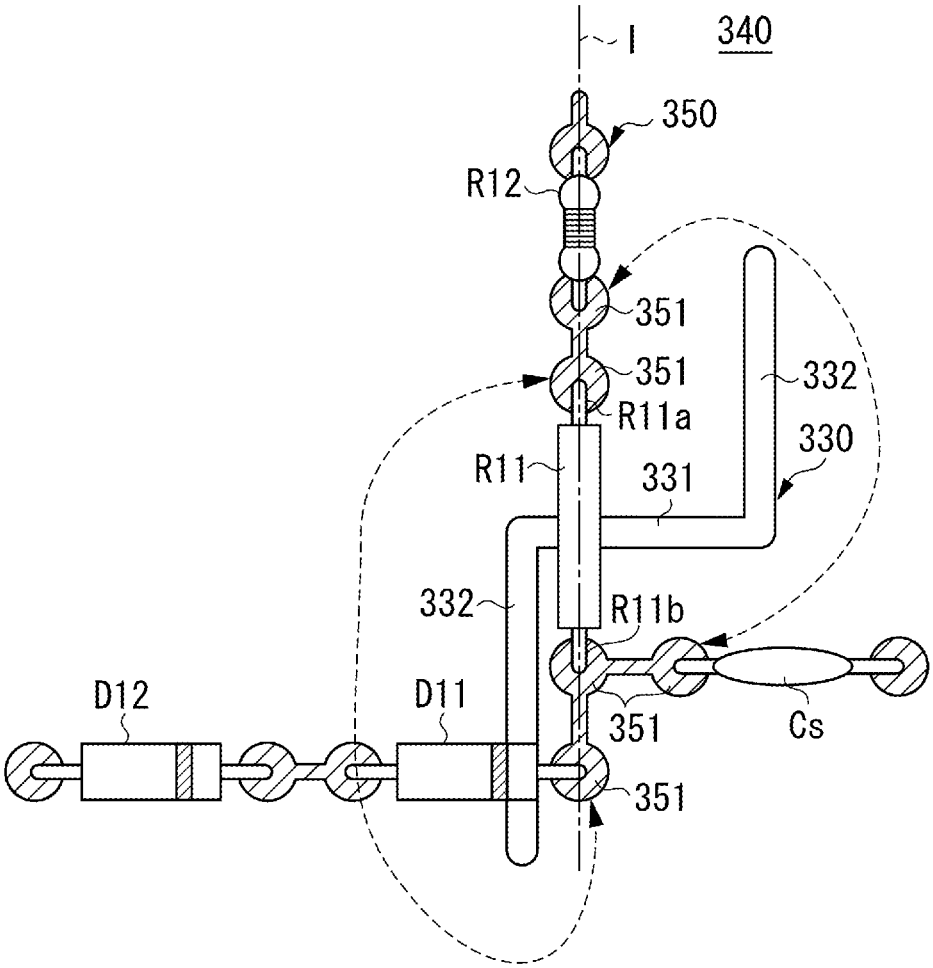
FIG. 8 is a schematic view illustrating another example of a slit formed in a printed circuit board of a high-voltage power supply according to an exemplary embodiment of the present invention.

The slit 330 may include the second portion 332 continuing from one end portion of the first portion 331 as illustrated in FIG. 5. Alternatively, the slit 330 may include the second portion 332 continuing from both end portions of the first portion 331 and extending in a direction receding from the same terminal of the high-voltage resistor R11 as illustrated in FIG. 6. In these cases, formation of one slit 330 with respect to one high-voltage resistor R11 produces a sufficient advantageous effect according to a desired degree of prevention of leakage current. However, formation of at least two slits 330 respectively corresponding to the terminals of the high-voltage resistor R11 as illustrated in FIGS. 5 and 6 increases the advantageous effect of preventing leakage current. Alternatively, the slit 330 may include the second portion 332 continuing from both end portions of the first portion 331 and extending in directions receding from different terminals of the high-voltage resistor R11 as illustrated in FIG. 8. Alternatively, the slit 330 may include the second portions 332 and 332 continuing from one end portion of the first portion 331 and extending in a direction receding from one of the terminals of the high-voltage resistor R11 and also extending in a direction receding from the other one of the terminals of the high-voltage resistor R11, and may also include the second portions 332 and 332 continuing from another end portion of the first portion 331 and extending similarly as illustrated in FIG. 7. The above examples are described in more detail.

First, the example illustrated in FIG. 5 will be described in more detail. In this example, two slits 330 and 330 are formed in the printed circuit board 340 under the high-voltage resistor R11. One end portion of each of the slits 330 and 330 is in the form of a hook. Specifically, each of the slits 330 and 330 is bent in the middle, and the direction of an opening of the bent shape with respect to one terminal of the high-voltage resistor R11 recedes from another terminal. In other words, a first slit 330A includes a first portion 331 and a second portion 332. The first portion 331 of the first slit 330A is adjacent to a first terminal R11*a* of the high-voltage resistor R11 and extends across the straight line I. The second portion 332 of the first slit 330A continues from the first portion 331 and extends in the direction receding from a second terminal R11*b* of the high-voltage resistor R11. A second slit 330B includes a first portion 331 and a second portion 332. The first portion 331 of the second slit 330B is adjacent to the second terminal R11*b* of the high-voltage resistor R11 and extends across the straight line I. The second portion 332 of the second slit 330B continues from the first portion 331 and extends in the direction receding from the first terminal R11*a* of the high-voltage resistor R11.

Typically, the first portion 331 extends linearly in a direction that is substantially orthogonal to the straight line I, and the second portion 332 extends linearly in a direction that is substantially parallel to the straight line I. Further, typically, the lengths of the first portion 331 and the second portion 332 of the slit 330 in directions in which the first portion 331 and the second portion 332 respectively extend (longitudinal axial direction) are longer than the width of the slit 330 in a direction that is substantially orthogonal to the longitudinal axial direction. For example, the slit 330 with a width of 0.8 mm to 3.0 mm may be formed to suitably prevent leakage current while preventing the strength of the printed circuit board 340 from decreasing.

In this example, when dew condensation occurs, the path (illustrated with dashed arrow in FIG. 5) along the printed circuit board 340 bypasses the slit 330. In other words, the shortest creeping path between the terminals of the high-voltage resistor R11 is in the shape of a crank. Hence, formation of a leakage current path between the terminals of the high-voltage resistor R11 due to continuous dew condensation can be prevented.

In this example, each of the first and second slits 330A and 330B includes the second portion continuing from one end portion of the first portion 331. In this case, the second portions 332 of the first and second slits 330A and 330B may desirably continue from the first portions 331 of the first and second slits 330A and 330B, respectively, at end portions on the opposite sides in a direction across the straight line I. This can efficiently increase the creeping distance between the terminals of the high-voltage resistor R11 on both sides of the straight line I while reducing the entire length of the slit 330. Reduction of the entire length of the slit 330 is advantageous in simplification of production steps and prevention of the strength of the printed circuit board from decreasing.

The second portion 332 may desirably extend from one of the terminals (R11*a* or R11*b*) of the high-voltage resistor R11 to a part beyond another one of the terminals (R11*a* or R11*b*) of the high-voltage resistor R11 in the direction along the straight line I. The second portion 332 may more desirably extend to a part beyond the copper foil pattern 350 between that another one of the terminals (R11*a* or R11*b*) of the high-voltage resistor R11 and an adjacent electronic component (resistor R12, diode D11, or capacitor Cs). This increases the creeping distance between the terminals of the high-voltage resistor R11 and suitably prevents a leakage current path formed by continuous condensation from reaching the terminals of the high-voltage resistor R11. The first portion 331 may desirably extend in the direction across the straight line I from the straight line I to a part beyond the terminal (R11*a* or R11*b*) of the high-voltage resistor R11 on both sides of the straight line I. The first portion 331 may further desirably extend beyond the copper foil pattern 350 between the terminal (R11*a* or R11*b*) and an adjacent electronic component (resistor R12 or diode D11 or capacitor Cs).

The example illustrated in FIG. 6 will be described in more detail. In this example, as in the example illustrated in FIG. 5, two slits 330 and 330 are formed in the printed circuit board 340 under the high-voltage resistor R11, and each of the slits 330 and 330 is U-shaped. Specifically, each of the slits 330 and 330 is bent in the middle to be U-shaped, and the direction of an opening of the U-shape with respect to one of the terminals recedes from the other one of the terminals. In other words, the first and second slits 330A and 330B include the second portions 332 and 332 continuing from both end portions of the first portion 331, respectively. Each of the second portions 332 and 332 of the first slit 330A extends in the direction receding from the second terminal R11*b* of the high-voltage resistor R11. Each of the second portions 332 and 332 of the second slit 330B extends in the direction receding from the first terminal R11*a* of the high-voltage resistor R11. In this example, as in the example illustrated in FIG. 5, the second portion 332 extends along the straight line I to a part beyond the copper foil pattern between the terminal of the high-voltage resistor R11 an electronic component.

In this example, as in the example illustrated in FIG. 5, when dew condensation occurs, a path (illustrated with the dashed arrow in FIG. 6) along the printed circuit board 340 bypasses the slit 330. Hence, formation of a leakage current path between the terminals of the high-voltage resistor R11 due to continuous dew condensation can be prevented.

In this example, each of the U-shaped slits 330 and 330 is formed to surround the copper foil pattern 350 connected to one of the terminals of the high-voltage resistor R11. The direction of the opening of each of the slits 330 and 330 formed to surround the copper foil pattern 350 recedes from the other one of the terminals. Thus, compared to the example illustrated in FIG. 5, the creeping distance between the terminals of the high-voltage resistor R11 can be increased even more on both sides of the straight line I. This can improve the effect of preventing leakage current.

The example illustrated in FIG. 7 will be described in more detail. In this example, one continuous slit 330 is formed in the printed circuit board 340 under the high-voltage resistor R11. The second portion 332 extends from both end portions of one first portion 331 in the directions of both terminals of the high-voltage resistor R11. In this example, as in the example illustrated in FIG. 5, the second portion 332 extends along the straight line I to a part beyond the copper foil pattern between the terminal of the high-voltage resistor R11 and an electronic component.

In this example, as in the example illustrated in FIG. 5, when dew condensation occurs, a path (illustrated in dashed arrow in FIG. 7) along the printed circuit board 340 bypasses the slit 330. Hence, formation of a leakage current path between the terminals of the high-voltage resistor R11 due to continuous dew condensation can be prevented.

Compared to the example illustrated in FIG. 6, one first portion 331 can be omitted in this example. Thus, the creeping distance between the terminals of the high-voltage resistor R11 can be increased efficiently while the entire length of the slit 330 is reduced.

The example illustrated in FIG. 8 will be described in more detail. In this example, as in the example illustrated in FIG. 7, one continuous slit 330 is formed in the printed circuit board 340 under the high-voltage resistor R11. However, from each end portion of one first portion 331, the second portion 332 extends only in the direction of either one of the terminals of the high-voltage resistor R11.

In this example, as in the example illustrated in FIG. 5, when dew condensation occurs, a path (dashed arrow in FIG. 7) along the printed circuit board 340 bypasses the slit 330. Hence, formation of a leakage current path between the terminals of the high-voltage resistor R11 due to continuous dew condensation can be prevented.

Compared to the example illustrated in FIG. 7, the creeping distance between the terminals of the high-voltage resistor R11 can be increased efficiently on both sides of the straight line I while the entire length of the slit 330 is reduced.

The slits 330 on one terminal side of the high-voltage resistor R11 of the examples illustrated in FIGS. 5 and 6 may be used in combination.

Although the AC high-voltage generating circuit 301 is described as an example in the foregoing description, a slit 330 similar to those described with reference to FIGS. 5 to 8 can be formed in the DC high-voltage generating circuit 302 with respect to the high-voltage resistor R21. This can prevent generation of leakage current caused by dew condensation between the terminals of the high-voltage resistor R21 of the DC high-voltage generating circuit 302.

As described above, according to the present exemplary embodiment, generation of leakage current caused by dew condensation in a resistor on the high resistance side of a voltage dividing circuit of a high-voltage power supply can be prevented. This reduces formation of an abnormal image to enable stable image formation. In other words, according to the present exemplary embodiment, when a high-voltage power supply is configured to control an output voltage generated by dividing a high-voltage output by a voltage dividing circuit to be constant, even if an environmental change occurs that is likely to cause dew condensation, generation of leakage current between terminals of a high-voltage resistor of the voltage dividing circuit can be prevented.

While the present invention has been described based on specific exemplary embodiments, it is to be understood that the present invention is not limited to the disclosed exemplary embodiments.

For example, while the exemplary embodiments are described using the AC high-voltage generating circuit and the DC high-voltage generating circuit of the charging high-voltage circuit board as examples, the same advantageous effect can be obtained by a development DC high-voltage generating circuit and a transfer DC high-voltage generating circuit. More specifically, as in the charging DC high-voltage generating circuit, a slit 330 similar to those described with reference to FIGS. 5 to 8 may be formed in a development DC high-voltage generating circuit and a transfer DC high-voltage generating circuit to prevent generation of leakage current caused by dew condensation between terminals of a high-voltage resistor. Accordingly, the high-voltage power supply may output: an AC voltage to be applied to a charging member as a member involved in image formation; a DC voltage to be applied to the charging member as a member involved in image formation; a DC voltage to be applied to a developer bearing member as a member involved in image formation; or a DC voltage to be applied to a transfer member as a member involved in image formation.

As to the shapes of the slits, the above exemplary embodiments show several examples, and the number and length of the slits for producing the advantageous effect of the present invention are not limited to those of the above-described exemplary embodiments. For example, each portion connecting the first portion 331 and the second portion 332 of the slits 330 illustrated in FIGS. 5 and 6 may be shaped in such a manner that one or both of the first portion 331 and the second portion 332 extrude from the other.

While the above exemplary embodiments describe an example in which feedback control is performed using the analog circuit and the error amplifier, the same advantageous effect is also produced when an output of a voltage dividing circuit is converted into a digital value through A/D conversion to perform feedback control using an application specific integrated circuit (ASIC) or a CPU.

While the above exemplary embodiments describe that the image forming apparatus is of an intermediate transfer method, the image forming apparatus may be of a direct transfer method. An image forming apparatus of a direct transfer method includes, for example, a recording material bearing member such as a transfer belt in place of the intermediate transfer member as described in the above exemplary embodiments. A toner image is transferred directly from a photosensitive member onto a recording material bore and conveyed by the recording material bearing member. The present invention is also applicable to a high-voltage power supply of an image forming apparatus of a single color such as black.

According to the exemplary embodiments of the present invention, when a high-voltage power supply is configured to control an output voltage generated by dividing a high-voltage output by a voltage dividing circuit to be constant, even if an environmental change occurs that is likely to cause dew condensation, generation of leakage current between terminals of a high-voltage resistor of the voltage dividing circuit can be prevented.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-173428 filed Aug. 3, 2012, which is hereby incorporated by reference herein in its entirety.

What is claimed is:

1. A high-voltage power supply for an image forming apparatus configured to compare a detected output voltage generated by dividing a high-voltage output by a voltage dividing circuit with a control value to feedback control the high-voltage output and output a voltage to be applied to a member involved in image formation, the high-voltage power supply comprising:

a printed circuit board on which a resistor connected to a high-voltage output side of the voltage dividing circuit is mounted; and a slit formed in the printed circuit board and including a first portion and a second portion, the first portion extending across a straight line connecting terminals of the resistor, and the second portion continuing from the first portion and extending in a direction receding from one of the terminals of the resistor.

2. The high-voltage power supply according to claim 1, wherein the slit includes the second portion continuing from one end portion of the first portion.

3. The high-voltage power supply according to claim 1, wherein the second portion of the slit continues from both end portions of the first portion and extends in a direction receding from a same terminal of the resistor.

4. The high-voltage power supply according to claim 1, wherein the second portion of the slit continues from both end portions of the first portion and extends in directions receding from different terminals of the resistor.

5. The high-voltage power supply according to claim 1, wherein the slit includes the second portion continuing from one end portion of the first portion and extending in a direction receding from one of the terminals of the resistor and also extending in a direction receding from another one of the terminals of the resistor, and wherein the slit also includes the second portion continuing from another end portion of the first portion and extending in a direction receding from one of the terminals of the resistor and also extending in a direction receding from another one of the terminals of the resistor.

6. The high-voltage power supply according to claim 1, wherein the second portion extends from one of the terminals of the resistor to a part beyond another one of the terminals of the resistor in a direction along the straight line.

7. The high-voltage power supply according to claim 1, wherein the second portion extends from one of the terminals of the resistor to a part beyond a wiring pattern between another one of the terminals of the resistor and an adjacent electronic component in a direction along the straight line.

8. The high-voltage power supply according to claim 1, wherein the first portion extends linearly in a direction substantially orthogonal to the straight line.

9. The high-voltage power supply according to claim 1, wherein the second portion extends linearly in a direction substantially parallel to the straight line.

10. The high-voltage power supply according to claim 1, wherein the high-voltage power supply outputs, as a device used for image formation, an AC voltage to be applied to a charging member for charging an electrophotographic photosensitive member, a DC voltage to be applied to the charging member for charging the electrophotographic photosensitive member, a DC voltage to be applied to a developer bearing member for supplying toner to the electrophotographic photosensitive member, or a DC voltage applied to a transfer member for transferring toner from an image bearing member to a member to be transferred.

11. A high-voltage power supply for an image forming apparatus configured to compare a detected output voltage generated by dividing a high-voltage output by a voltage dividing circuit with a control value to feedback control the high-voltage output and output a voltage to be applied to a member involved in image formation, the high-voltage power supply comprising:

a printed circuit board on which a resistor connected to a high-voltage output side of the voltage dividing circuit is mounted;

a first slit formed in the printed circuit board and including a first portion and a second portion, the first portion being adjacent to a first terminal of the resistor and extending across a straight line connecting the first terminal and a second terminal of the resistor, and the second portion continuing from the first portion and extending in a direction receding from the second terminal of the resistor; and a second slit formed in the printed circuit board and including a first portion and a second portion, the first portion being adjacent to the second terminal of the resistor and extending across the straight line, and the second portion continuing from the first portion and extending in a direction receding from the first terminal of the resistor.

12. The high-voltage power supply according to claim 11, wherein the first slit and the second slit includes the second portions, and the second portions of the first slit and the second slit each continue from one end portion of the respective first portion of the first slit and the second slit, at end portions on opposite sides in a direction across the straight line.

13. The high-voltage power supply according to claim 11, wherein t the first slit and the second slit respectively include the second portions that continue from both end portions of the first portions of the first slit and the second slit.

14. The high-voltage power supply according to claim 11, wherein the second portion extends from one of the terminals of the resistor to a part beyond another one of the terminals of the resistor in a direction along the straight line.

15. The high-voltage power supply according to claim 11, wherein the second portion extends from one of the terminals of the resistor to a part beyond a wiring pattern between another one of the terminals of the resistor and an adjacent electronic component in a direction along the straight line.

16. The high-voltage power supply according to claim 11, wherein the first portion extends linearly in a direction substantially orthogonal to the straight line.

17. The high-voltage power supply according to claim 11, wherein the second portion extends linearly in a direction substantially parallel to the straight line.

18. The high-voltage power supply according to claim 11, wherein the high-voltage power supply outputs, as a device used for image formation, an AC voltage to be applied to a charging member for charging an electrophotographic photosensitive member, a DC voltage to be applied to the charging member for charging the electrophotographic photosensitive member, a DC voltage to be applied to a developer bearing member for supplying toner to the electrophotographic photosensitive member, or a DC voltage applied to a transfer member for transferring toner from an image bearing member to a member to be transferred.

* * * * *